United States Patent [19]

Ozaki et al.

[11] Patent Number: 4,462,355

[45] Date of Patent: Jul. 31, 1984

[54] THROTTLE VALVE CONTROL APPARATUS FOR INTERNAL COMBUSTION ENGINE

[75] Inventors: Syunzaburo Ozaki, Sakado; Tooru Niwa, Kawagoe, both of Japan

[73] Assignee: Honda Giken Kogyo Kabushiki Kaisha, Tokyo, Japan

[21] Appl. No.: 477,668

[22] Filed: Mar. 22, 1983

[30] Foreign Application Priority Data

Mar. 24, 1982 [JP] Japan ..... 57-45571

[51] Int. Cl.[3] ..... F02M 3/06

[52] U.S. Cl. ..... 123/325; 123/339; 123/340; 123/399; 123/DIG. 11

[58] Field of Search ..... 123/320, 324, 325, 339–341, 123/399, 401, 403, DIG. 11; 261/DIG. 19

[56] References Cited

U.S. PATENT DOCUMENTS

| | | | |
|---|---|---|---|
| 3,682,148 | 8/1972 | Harrison et al. | 123/198 DB |
| 4,128,087 | 12/1978 | Hayashi et al. | 123/DIG. 11 |
| 4,196,704 | 4/1980 | Cook | 123/339 |
| 4,300,501 | 11/1981 | Suzuki | 123/339 |
| 4,355,605 | 10/1982 | Robinson et al. | 123/320 |
| 4,391,246 | 7/1983 | Kawabata et al. | 123/341 |

*Primary Examiner*—William A. Cuchlinski, Jr.
*Attorney, Agent, or Firm*—Armstrong, Nikaido, Marmelstein & Kubovcik

[57] ABSTRACT

Throttle valve control apparatus including an idle-speed increasing device for causing the throttle valve to open beyond the normal idle position according to engine load, a valve closing device for permitting the throttle valve to close beyond the normal idle position when the engine is decelerating or the like, and a restraining mechanism for restraining the operation of the idle-speed increasing device during operation of the valve closing device.

2 Claims, 1 Drawing Figure

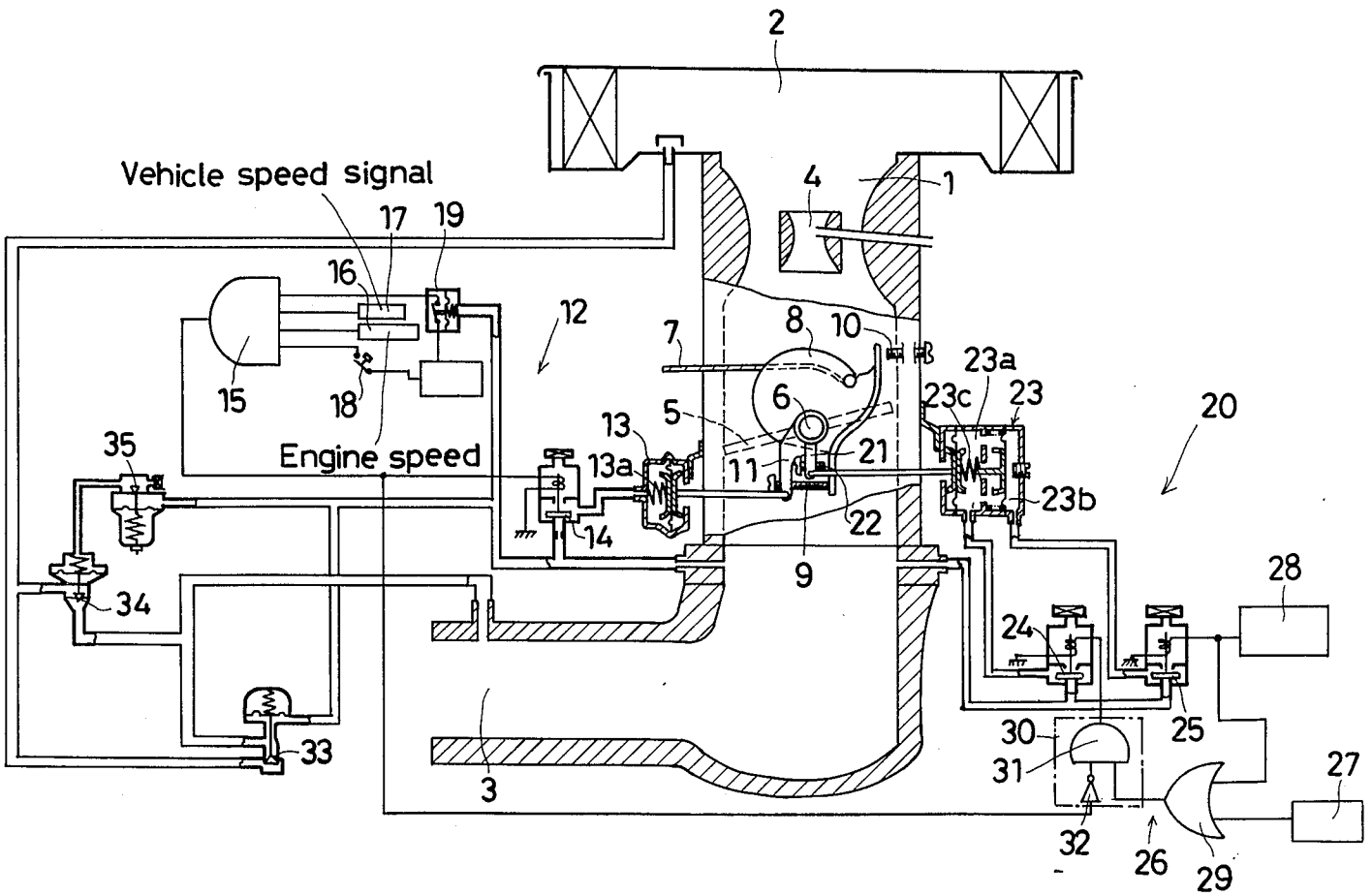
Vehicle speed signal
Engine speed

THROTTLE VALVE CONTROL APPARATUS FOR INTERNAL COMBUSTION ENGINE

BACKGROUND OF THE INVENTION

This invention relates to a throttle valve control apparatus in an internal combustion engine mounted on a motorcar or the like.

Known throttle valve control apparatuses for instance, as shown in Unexamined Publication Showa 54-74824 of Japanese Utility Model Application, can be provided with an automatic idle speed increasing means for causing a throttle valve, in the intake passage of the engine, to open beyond a predetermined idling position according to the increase in engine load caused by use of an air cooler, a lamp or the like in order to prevent the engine from stalling. Additionally, there has been known also, for instance, in Japanese Patent Publication Showa 56-13177, throttle valve control apparatus provided with a valve closing means for closing the throttle valve in the intake passage of the engine beyond a predetermined idling position when the valve is closing at the time of deceleration, descending of a slope or the like in order to improve the fuel economy of the engine and protect the exhaust gas purification catalyzer. Of course, both of the foregoing two means can be provided in the same apparatus.

If, in such a case that both means are provided, the two means are simultaneously operated at the time of deceleration when using an air cooler or the like, it is usual that the throttle valve is subjected only to the operation of the idle speed increasing to be opened beyond the idling position, whereby disadvantages in respect of fuel cost economy, catalyzer protection, engine brake effect, etc. are caused.

The idle speed increasing means is not required to be operated when the engine is subjected to torque from the driving wheel side at the time of deceleration, descending of a slope or the like, and accordingly it is desirable, in such a case that the two means are provided, that the operation of the idle speed increasing means be restrained at the time of operation of the valve closing means.

OBJECTS AND SUMMARY OF THE INVENTION

The present invention has as an object thereof the provision of a throttle valve control apparatus having both an idle speed increasing means and a valve closing means in a vehicle engine wherein the idle speed increasing means is restrained when the valve closing means is operated.

It is a further object of the present invention to provide a throttle valve control apparatus which helps prevent engine stalling while retaining good fuel economy and catalyzer protection during deceleration, descent of a slope, and the like.

These objects are obtained in an apparatus comprising an idle speed increasing means for causing a throttle valve in an intake passage of an engine to open beyond a predetermined idling position thereof according to increase in an engine load, a valve closing means for causing the throttle valve to close beyond the predetermined idling position at the time of closing operation of the throttle valve for deceleration or the like, and a restraining means for restraining the operation of the idle speed increasing means for causing a throttle valve in an intake passage of an engine to open beyond a predetermined idling position at the time of closing operation of the throttle valve for deceleration or the like, and a restraining means for restraining the operation of the idle-speed increasing means during the operation of the valve closing means.

BRIEF DESCRIPTION OF THE DRAWING

The above and other objects and the attendant advantages of the present invention will become readily apparent by reference to the following detailed description when considered in conjunction with the accompanying drawing which is system diagram showing one example of this invention apparatus.

DETAILED DESCRIPTION OF PREFERRED EMBODIMENTS

One embodying example of this invention will now be explained with reference to the accompanying drawing:

Referring to the drawing, an intake passage 1 of an internal combustion engine is provided with an air cleaner 2 on the upstream end thereof and an intake manifold 3 on the downstream end thereof. Between the air cleaner 2 and the intake manifold 3 is a carburetor 4. A throttle valve 5 is provided on the downstream side of the carburetor 4.

The throttle valve 5 is turnable in the intake passage 1 through a rotary shaft 6. A lever member 8 having a throttle wire 7 attached thereto and connected to an acceleration pedal (not shown) is fixed to the rotary shaft 6 so that the throttle valve 5 may be turned in an opening direction (counterclockwise in the drawing) if the wire 7 is pulled, and be turned in a closing direction (clockwise) by the action of a return spring (not shown), if the wire 7 is released from being pulled such as in the case of deceleration, descending of a slope or the like. Additionally, the throttle valve 5 is so arranged that the turning thereof in the closing direction may be stopped at a predetermined idling position thereof by an idling stopper 9 arranged to be brought into abutment with the lever member 8, and further may be turned to a closed-valve position thereof set in position by a closed-valve stopper 10 if the stopper 9 is retreated from the illustrated operative position in an inoperative position thereof, that is to the left of the drawing.

The idling stopper 9 is attached to a swing arm 11 mounted swingably on the foregoing rotary shaft 6 so that the same may be moved to advance and retreat between the operative position and its inoperative position by swinging of the swing arm 11. A valve closing means 12 for permitting the throttle valve 5 to turn to a closed-valve position by causing the stopper 9 to retreat to its inoperative position is constructed as described below.

Namely, the valve closing means 12 comprises a negative pressure actuator 13 connected to the arm 11, a control valve 14 for applying thereto the intake negative pressure generated in the intake passage 1, and a control circuit 15 for the valve 14. The control circuit 15 comprises and AND circuit arranged to be inputted with an engine speed signal from an engine speed sensor 16, a vehicle speed signal from a vehicle speed sensor 17, an ON-OFF signal of a clutch switch 18 arranged to be moved with a clutch pedal (not shown) and an ON-OFF signal of a negative pressure switch 19 arranged to be applied with the intake negative pressure. A high level operation signal is generated from the control circuit 15 under a predetermined driving condition such that the engine speed is above a predetermined value, the vehicle speed is above a predetermined value, the clutch switch 18 is in its ON condition (clutch pedal is inoperative) and the negative pressure switch 19 is also in its ON condition, whereby the control valve 14 is opened, so that the negative pressure actuator 13 is operated by the intake negative pressure. Consequently, the idling stopper 9 is moved by the arm 11 to its inoperative position to permit the throttle valve 5 to turn to the closed valve position thereof. A low level inoperative signal is generated from the control circuit 15 if the engine speed is lowered to at or below a predetermined returning speed, whereby the control valve 14 is closed and consequently the idling stopper 9 is advanced to its operative position by the action of a return spring 13*a* of the actuator 13. Thus, the throttle valve 5 is caused to return to its predetermined idling position.

Referring to the drawing, an idle speed increasing means 20 causing the throttle valve 5 to open beyond the predetermined idling open degree according to increase in an engine load comprises an arm member 22 attached to a swing arm 21 swingably mounted on the rotary shaft 6 for pushing the throttle valve 5 in its opening direction by abutment with the lever member 8. A negative pressure actuator 23 is connected to the spring arm 21 and has first and second negative pressure chambers 23*a*, 23*b*. First and second control valves 24, 25 for applying intake negative pressure are connected to the respective negative pressure chambers 23*a*, 23*b*. A control circuit 26 is provided for the two control valves 24, 25. The control circuit 26 has a first load sensor 27 arranged to generate a high level operation signal on detecting a small load to the engine such as an electric load or the like and a second load sensor 28 arranged to generate a high level operation signal on detecting a large to the engine. The signals from these two sensors 27, 28 are inputted through an OR circuit 29 to the first control valve 24. The signal from the second load sensor 28 is also inputted to the second control valve 25.

If, thus the operation signal from the first load sensor 27 is generated, the first control valve 24 is opened to cause the negative pressure to be applied to the first negative pressure chamber 23*a*. This first stage actuation of the negative pressure actuator 23 against the action of a spring 23*c* results in the arm member 22 being advanced moving the swing arm 21 to a first operation position, that is, to the right in the drawing, whereby the valve 5 is pushed through lever 8 to turn in its opening direction by a little amount from the initial idling position thereof. If, further, the operation signal from the second load sensor 28 is generated, the second control valve 25 is also opened applying intake negative pressure to the second negative pressure chamber 23*b*. The negative pressure actuator 23 is given a second stage actuation, whereby the arm member 22 advances the swing arm to a second operation position further to the right of the first operation position and the degree of opening of the throttle valve 5 is further increased.

Supposing that the foregoing valve closing means 12 and the foregoing idle-speed increasing means 20 are provided simply without an interconnection between the two, when the two means 12, 13 are simultaneously operated, the throttle valve 5 is opened beyond the predetermined idling position by the advance movement of the idle-up member 22 even if the idling stopper 9 is retreated. To eliminate this, according to this invention, there is provided a restraining means 30 for restraining the operation of the idle-speed increasing means 20 during the operation of the valve closing means 12 so that the throttle valve 5 may be surely closed beyond the idling position when the valve closing means 12 is operated.

The restraining means 30 comprises an AND circuit 31 provided on the output side of the foregoing OR circuit 29 and an invertor means 32 for inputting, after reversed, the signal for the valve closing means 12 from the control circuit 15 and to the AND circuit 31. In this manner, at the time of operation of the valve closing means 12 caused by generating the high level operation signal from the control circuit 15, a low level operation stop signal is inputted through the inverter means 32 to the AND circuit 31, whereby the first control valve 24 is kept in a closed-valve condition and any operation of the idle-speed increasing means 20 is restrained. Further, if the low level inoperative signal is generated from the control circuit 15 as mentioned before when the engine speed is lowered to the predetermined returning speed, the high level operation signal is inputted to the AND circuit 31 through the inverter means 32, whereby when the high level operation signals are generated from the respective sensors 27, 28, the idle-up means 20 is operated immediately for ensuring prevention of the engine stalling.

Referring to the drawing, an anti-afterburning valve 33 and a secondary air valve 34 can be provided in parallel with one another serving to introduce secondary air into the intake manifold 3. A control valve 35 can be provided for the secondary air valve 34.

Thus, according to this invention, there is provided the restraining means for restraining the operation of the idle-speed increasing means during the operation of the valve closing means, so that an unnecessary opening of the throttle valve by the idle-speed increasing means at the time of deceleration or the like can be prevented.

It is readily apparent that the above-described throttle valve control apparatus meets all of the objects mentioned above and also has the advantage of wide commerical utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A throttle valve control apparatus in an internal combustion engine having an idle-speed increasing means for causing a throttle valve in an intake passage of an engine to open beyond a predetermined idling position thereof according to increase in an engine load, and a valve closing means for permitting the throttle valve to close beyond the predetermined idling position at the time of closing operation of the throttle valve, for deceleration or the like, characterized in that there is provided a restraining means for restraining the operation of the idle-speed increasing means during the operation of the valve closing means.

2. A throttle valve control apparatus of claim 1, wherein the valve closing means comprises an idling stopper attached to a swing arm mounted swingably on a rotary shaft of the throttle valve, a negative pressure actuator connected to the arm, a control valve for applying the intake negative pressure in the intake passage to the actuator, and a control circuit for the control valve; the idle-up means comprises an arm member attached to a swing arm mounted swingably on the rotary shaft, a negative pressure actuator connected to the arm member, at least one control valve for applying the intake negative pressure to the negative pressure actuator, and a control circuit for the control valve; and the restraining means comprises an AND circuit provided in the control circuit of the idle-speed increasing means and inverter means provided on the input side of the AND circuit and connected to the control circuit of the valve closing means.

* * * * *